US005399198A

United States Patent [19]

Ghaisas

[11] Patent Number: 5,399,198

[45] Date of Patent: Mar. 21, 1995

[54] ELECTROSTATIC POWDER COATING

[76] Inventor: Yashwant G. Ghaisas, 'Anand Tarang', 17 Shivparvati Housing Society, Paud Road, Pune 411 038, Maharashtra Street, India

[21] Appl. No.: 259,169

[22] Filed: Jun. 13, 1994

Related U.S. Application Data

[63] Continuation of Ser. No. 941,311, Sep. 4, 1992, abandoned.

[51] Int. Cl.[6] ..... B05B 5/025

[52] U.S. Cl. ..... 118/629; 118/308; 118/624; 239/687

[58] Field of Search ..... 118/621, 622, 624, 627, 118/629, 308; 239/681, 687

[56] References Cited

U.S. PATENT DOCUMENTS

| | | | |
|---|---|---|---|
| 2,604,870 | 7/1952 | Blood et al. | 118/308 X |
| 2,901,178 | 8/1959 | Norris | 118/621 X |
| 3,144,350 | 8/1964 | Osame | 118/629 X |
| 4,761,299 | 8/1988 | Hufstetler et al. | 118/629 X |
| 4,986,475 | 1/1991 | Spadafora et al. | 118/24 X |
| 5,046,664 | 9/1991 | van der Lely et al. | 239/687 X |
| 5,073,032 | 12/1991 | Berion et al. | 118/308 X |

*Primary Examiner*—David A. Simmons
*Assistant Examiner*—Paul M. Rivard
*Attorney, Agent, or Firm*—Breiner & Breiner

[57] ABSTRACT

Electrostatic powder coating apparatus comprising a spray module located within a bight of a conveyor having suspended from it a plurality of articles to be coated with powder prior to heat treatment to convert the powder into an adherent coat of paint or the like.

The spray module comprises a veined impeller able to rotate about a vertical axis and having charged powder projected towards its center from a stationary nozzle so that vanes on the impeller impart centrifugal force to the powder particles.

The impeller and nozzle assembly may be reciprocated vertically so that the sprayed powder traverses the length of the suspended and moving articles.

8 Claims, 6 Drawing Sheets

ELECTROSTATIC POWDER COATING

This is a continuation of copending application Ser. No. 07/941,311, filed on Sep. 4, 1992, now abandoned.

FIELD OF THE INVENTION

This invention relates to apparatus for effecting electrostatic powder coating, in which process an article is first coated with powder by earthing it and spraying it with charged powder. Because of electrostatic attraction, the charged powder gets deposited over the article to be coated. Subsequently the coated article is conveyed or transferred to an oven in which it is heated to cause the powder to melt and cure to form a strong, adherent protective coat.

BACKGROUND TO THE INVENTION

Electrostatic powder coating apparatus requires dry powder to be conveyed to a spray head in fluidized form, electrostatically charged and dispensed from the spray head towards the article. In known coating apparatus (powder spray guns) powder is fluidized in a container and conveyed to the spray head (gun) using compressed air. It is dispensed from the spray head by using a deflector, diffuser or other spray pattern shaper. The powder is charged electrostatically by either corona charging, using high tension pointed electrodes, or friction charging, alone or in combinations. The powder particles are carried to the articles under electrostatic field attraction, pneumatic force and their own momentum. The fine powder spray from the spray head, in a defined fan pattern in the plane of the article, coats the article surface. There are various limitations, like the Faraday cage effect from corona charging, chemical formulation of the powder for friction charging.

The powder application process can be manual or automatic, using mechanical means like reciprocators, depending on the size and number of articles to be coated in a stipulated period.

An alternative to pneumatic powder spraying uses an electrostatic fluidized bed, wherein articles are introduced into a fluidized powder bed, and coating is carried out under electrostatic field only (without the use of air to carry powder to the articles). This process can also be in manual or automated versions.

Both the known processes, spray gun using pneumatic pressure, and fluidized bed using pure electrostatic attraction, have their advantages and limitations. However, the pneumatic type is more versatile and is used far more than is the fluidized bed.

Pneumatic applicators normally have an optimum value of powder throughput of 200 gms/min. though its maximum output can be 500 gms/min. with low charging and transfer efficiency. To achieve coating on opposite sides, a minimum of two guns are required spraying from opposite ends. For jobs with four sides, sometimes four applicators are used with indexing. The automatic applicators are vertically reciprocated to cover the total height of the articles. The number of applicators to be used can be large in order to match the speed of article, travel time, and its height or configuration, as articles are facing applicators for very small amount of time. For small components pneumatic force dispensing of powder can cause strong oscillations as the articles are often of light weight.

In the case of fluidized bed coating, the Faraday cage effect is a major limitation for articles of complex shape.

A further disadvantage is that the thickness of the coating, and therefore of the final film, varies to an unacceptable extent on articles above about 50 mm in height.

GENERAL DESCRIPTION OF THE INVENTION

The present invention provides a non pneumatic powder spray applicators capable of dispensing powder up to 1 kg/min with optimum efficiency, or even up to 2 kg/min, thus replacing number of spray guns where large surface areas are to be coated. The present invention provides an arrangement wherein articles remain in spray zone for a considerable length of time thus exposing all article surfaces and also the full article length (height) to a single applicator. A further novelty of the applicator is that the distance between article and applicator remains the same throughout the powder application process, unlike the case of a pneumatic applicator, where the distance to the article on the conveyor is continuously changing.

Being non-pneumatic, oscillation of small articles is substantially or wholly avoided.

Specifically, the invention provides an apparatus for electrostatic powder coating, comprising a spray chamber having in its upper part a conveyor moveable in an endless path, in which part of the path of the conveyor forms a substantially-closed bight, the improvement consisting in providing a powder spray module having a substantially vertical axis of rotation positioned within the bight, whereby articles (to be coated) suspended from the conveyor are located in the path of the powder spray.

According to this invention, the apparatus does not use pneumatic pressure but uses centrifugal force for dispensing the powder particles towards the articles to be coated. The powder is charged electrostatically and then dispensed without a strong electrostatic field, thus minimizing the Faraday cage effect. Moreover, the articles are carried on a conveyor or like mechanical means circumscribing the powder coating module so that their distance from the applicators stays constant during spraying. All faces of the article can be exposed by indexing them, and the articles remain in the powder application area or spray zone for a sufficiently-long time, thereby increasing the application flexibility for coating long vertically extending articles.

Thus, this invention provides a cost-effective automatic powder coating apparatus which is more efficient, has a large powder throughput, requires less space for the spray chamber, and is less complicated as reciprocators and pneumatic applicators are not needed, all this irrespective of whether the articles are small or large.

In a particularly preferred embodiment, the conveyor may have two bights, i.e. S-shaped as seen from above. This enables articles to be coated without the need to index them or rotate them about a vertical axis, so enabling even higher output while retaining great efficiency of operation.

Typically electrostatic powder coating apparatus according to the invention comprises a closed chamber having in its upper part a motor-driven conveyor movable in an endless loop having in it a bight centered on the powder coating module comprising a rotary impeller adapted to rotate at a fixed angular speed and which is capable of reciprocating along its axis of rotation. The rotary impeller receives electrostatically-charged powder through a nozzle assembly which in turn receives fluidized powder through a powder feed tube. The nozzle assembly is fixed to a dielectric cover. The impeller is intended to be rotated at a fixed speed, and to reciprocate in a vertical direction at a linear speed selected in accordance with the articles to be coated. The vertical stroke length of the reciprocation can also be varied in accordance with the height of the articles to be coated. This stroke length should be at lest 50 mm greater than the span of the article.

The powder particles leaving the impeller are dispersed towards the article to be coated by:

a) Centrifugal force;

b) Aerodynamic force;

c) Electrostatic field, and d) Momentum a) Centrifugal Force

The centrifugal force is imparted to the powder particles by rotation of the impeller. Any slippage in the tangential direction is reduced by radial fins incorporated in the impeller.

The charged powder being fed to the rotary impeller gets uniformly ejected substantially radially by centrifugal force without any tangential slippage. This is achieved by providing an upward slant $\theta 1$. The upper limit for $\theta 1$ is the angle of repose at which the radial movement will be sluggish thus achieving accumulation of powder and then distribute it uniformly into the plurality of fins. Accordingly $\theta 1$ is selected well below the angle of repose i.e. around 0° to 30°. The optimum uniform distribution of powder without excessive accumulation is achieved at an angle of about 10 degrees.

The number of radial fins z is chosen as a compromise between the Eck recommendations, which produce $$z = \frac{8.5 \text{ Sin } B2}{1 - \frac{d1}{d2}} = 18$$

and the Steppenhoff recommendations which give $$z = \tfrac{1}{3} \text{ B2} = 30$$

so the average preferably chosen in practice is $$z = (18+30)/2 = 24$$

where, in these equations,

B2 = exit blade angle = 90 deg.

d1 = Internal diameter of blade portions d2 = External diameter of blade portions A streamline shape for the radial fins is preferably chosen.

The angular speed of these radial fins is imparted to the powder particles and because of centrifugal force these powder particles start travelling radially on the bottom surface of the impeller and achieve a sufficient ejection speed to get deposited over the articles to be coated.

b) Aerodynamic Force

The fins on the impeller when rotated eject air radially, which leads to a sub-atmospheric pressure being produced at the centre of the impeller. This in turn creates an axial airflow. The air being sucked through the space of annular cross-section between the impeller shaft and the cylindrical cover is used for conveying powder particles towards the articles to be coated. The speed of the air leaving the impeller is adjusted so that it will not impart any major oscillations to small objects but is sufficient to overcome the Faraday cage effect.

c) Electrostatic Force

The powder is fed to the impeller through a nozzle assembly. The nozzle assembly constitutes 32 electrodes which are connected to a high-voltage generator generating 100 kV negative voltage which creates an intense electrostatic field. The powder is passed through this intensive electrostatic field and gets charged. This charged powder, when dispersed by the impeller, gets further propelled by electrostatic attraction towards the earthed articles to be coated.

In the absence of any external corona-generating electrode, the charged powder gets deposited uniformly on the articles suspectible to Faraday cage effect.

d) Momentum

The impeller disc, is dished. As the powder slides over the sloping surface under centrifugal force, an upward component of motion is imparted to the powder particles. This upward component imparts sufficient momentum to help in applying powder particles to the undersurfaces of articles to be coated.

BRIEF DESCRIPTION OF THE DRAWINGS

The invention will be further described by way of example only with reference to the accompanying drawings in which.

DESCRIPTION OF SPECIFIC EMBODIMENTS OF THE INVENTION

Figure 1:
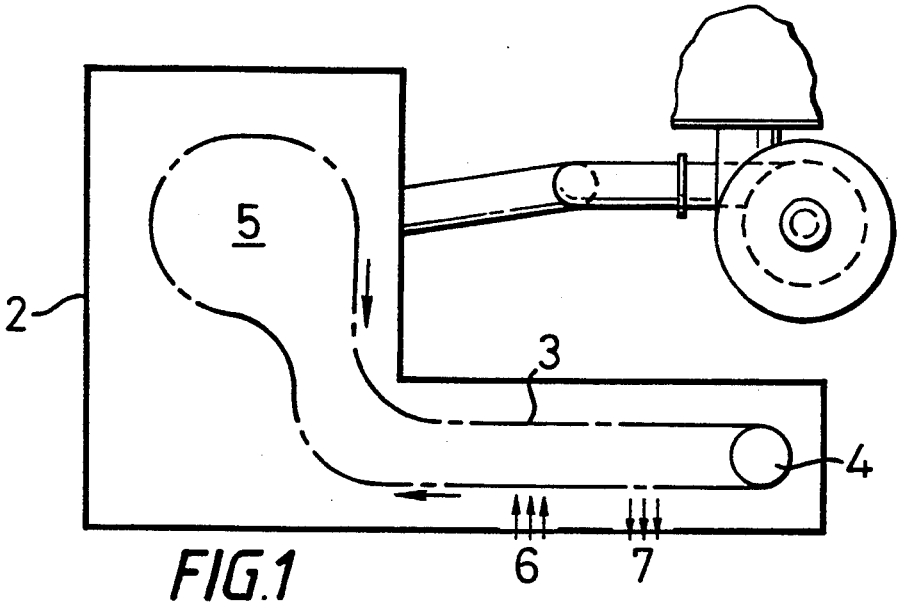
FIG. 1 is a diagrammatic plan view of the powder coating apparatus of the present invention for powder coating of small articles.
Figure 2:
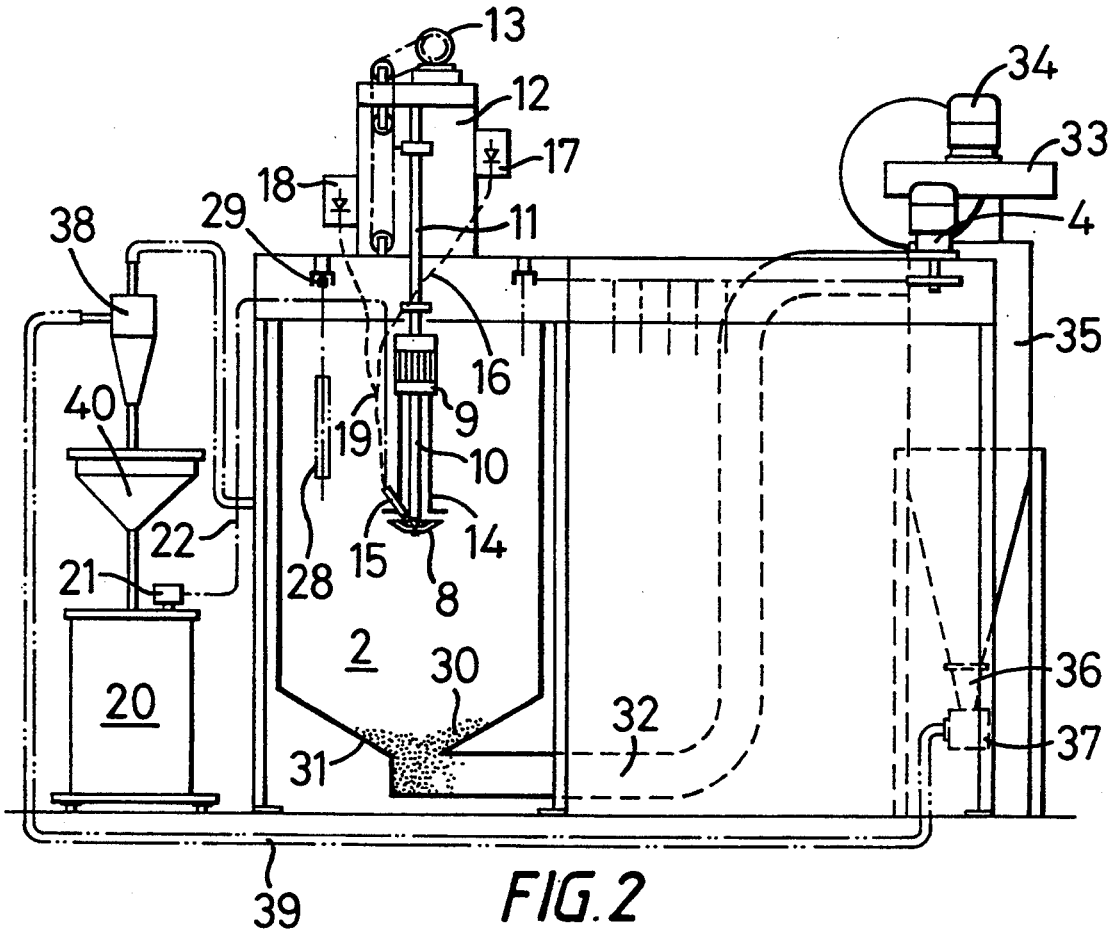
FIG. 2 is a side elevation of the apparatus show in FIG. 1.
Figure 3:
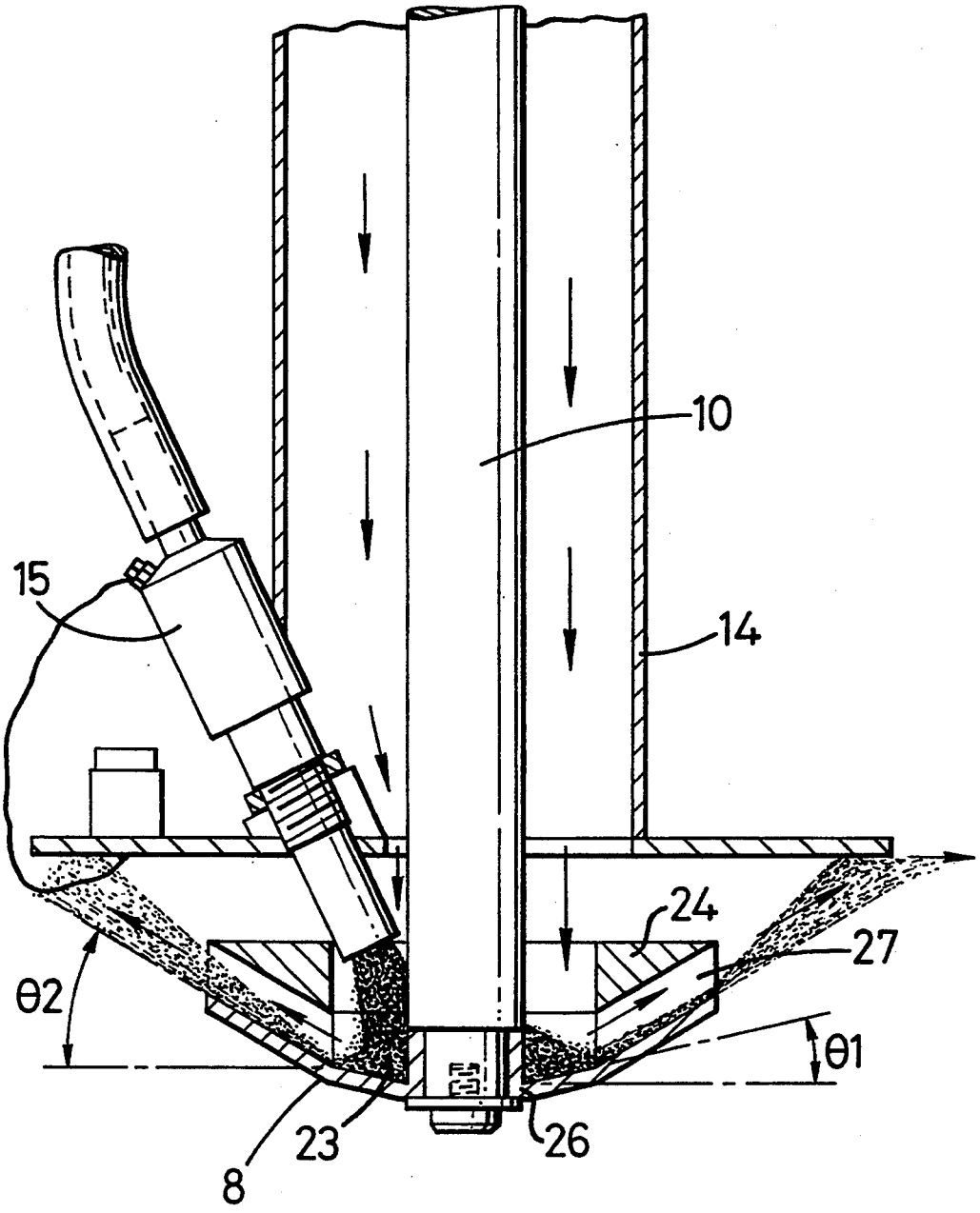
FIG. 3 is a side elevation of the spray chamber shown in FIG. 2 on a larger scale.
Figure 4:
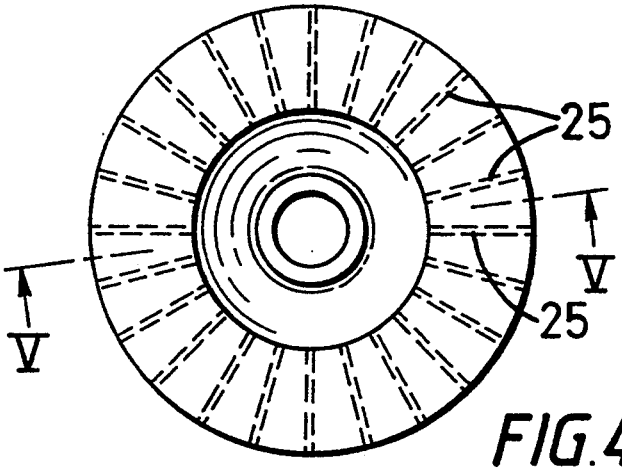
FIG. 4 is a plan view of the rotary impeller shown in FIGS. 2 and 3.

Referring first to FIGS. 1 to 7, apparatus according to the present invention comprises a closed spray chamber 2 having in its upper part a conveyor 3 driven by a motor 4. The conveyor 3 forms an endless loop 5, with the articles being loaded on to the conveyor at station 6 and unloaded at station 7. The supports defining the path of the conveyor have been generally omitted from the drawings, for clarity. The powder coating module consists of a rotary impeller 8 driven by a motor 9 through an insulated shaft 10. The motor 9 and the impeller 8 are mounted on a rod 11 of a reciprocating mechanism 12 driven by a motor 13. Extending around shaft 10 is a non-rotatable dielectric sleeve 14, which is movable vertically with motor 9. On sleeve 14 is mounted a non-rotatable nozzle assembly 15. High voltage is supplied to the nozzle assembly 15 by a high voltage cable 16 from a high voltage generator 17. Attached to nozzle assembly 15 is a bank 18 of resistors through another high-voltage cable 19, for selectively discharging any accumulated charge on the nozzle assembly. The powder paint to be sprayed is stored in a fluidized hopper 20 from which the fluidized powder is sucked by an ejector pump 21 and conveyed to the impeller assembly 8 through a pipe 22. The powder is projected at the centre 23 of the impeller 8. As shown in FIG. 3, the impeller is dished so that the powder discharge passages 27 slope upwardly and outwardly of the axis of rotation of the impeller, first at angle $\theta 1$ to the normal to the axis of rotation, and then at a greater angle $\theta 2$. The powder impacting the impeller gets dispersed in a uniform manner because of centrifugal force and the inclination of the passages 27. The impeller assembly 8 comprises a set of two discs, the upper one 24 as viewed having a plurality of radial fins or septa 25, while the lower disc acts as a cover 26. As shown in FIG. 4, the fins 25 preferably have a cross-sectional shape which tapers inwardly with increasing radius, so that they are thinner at the outside of the impeller than they are at their inner ends.

The articles 28 to be coated are suspended from links 29 in the conveyor 3 and are rotated continuously or intermittently about a vertical axis in order to receive a uniform powder coat. The excess powder 30 which does not adhere to the articles gets collected in a hopper 31 at the bottom of the chamber 2. The powder gets sucked through a duct 32 with the help of a centrifugal blower or ventilator 33 powered by a motor 34. The resultant air/powder mixture is fed to a cyclone separator 35. The recovered powder 36 collected at the bottom of the separator housing is sucked by pneumatic ejector pump 37 and is conveyed to a minicyclone separator 38 through a pipe 39, thus separating powder and air again. The separated powder from minicyclone 38 falls into a sifter hopper 40 in which it is sieved and fed back into hopper 20, thus maintaining a closed cycle for powder circulation. Fresh powder to replace that adhering to the coated articles is fed into hopper 20 as desired, by means which do not form part of the subject-matter of this invention and are therefore not described in any greater detail.

Figure 7:
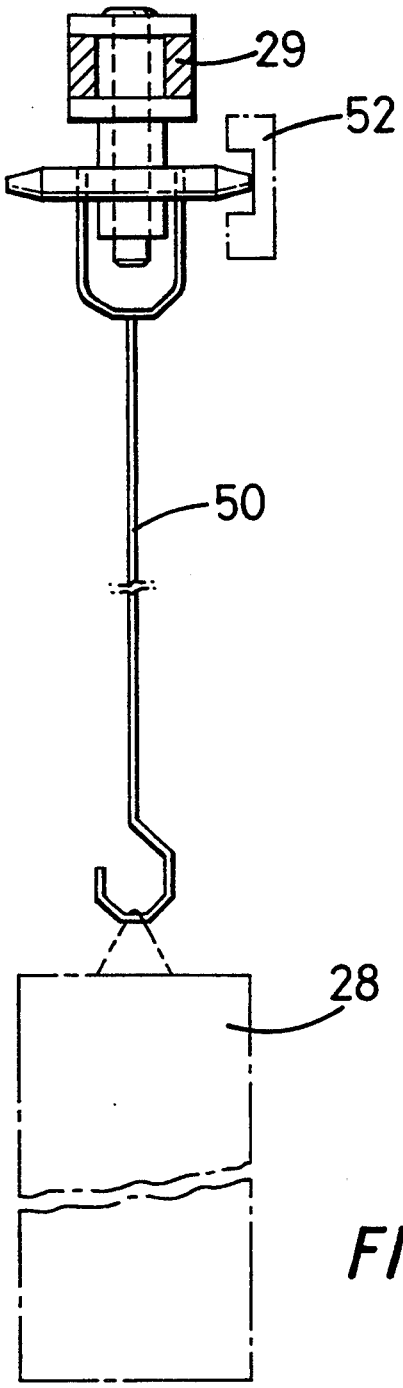
FIG. 7 is a view, part in section and part in elevation, of the means for suspending and rotating each article to be coated.

As shown in FIG. 7, each link 29 in the conveyor from which an article is suspended may be caused to rotate as the conveyor moves, thus rotating the article about its centre of gravity to expose fresh surfaces thereof to the impeller as the article is moved around the impeller. This is done by means of a rotary cogwheel 48 carried by link 29. The cogwheel carries a hook 50 from which the article 28 is suspended, and engages a rack 52 extending part way around the path of the conveyor. In this way the cogwheel, hook and article are rotated by movement of the conveyor relative to the rack.

It will be observed that the nozzle is non-rotatable yet is capable of reciprocating with the impeller assembly. The impeller is not connected to a high-voltage source, so that its voltage is able to float. The high-tension cable 16 is connected to the nozzle assembly to establish a high electrostatic field across the powder leaving the nozzle and charge the powder particles which then emerge from nozzle assembly 15 and pass into the centre of the impeller. There is no Faraday cage effect this way. The dished shape of the impeller and the upwardly-directed discharge passages ensure that the discharged powder particles have a vertical component of movement. This counteracts the force of gravity and assists in depositing the powder on complex surfaces.

The nozzle assembly 15 mounted on holder 41 has a conductive pin 45 connected to high-voltage generator 17 by cable 16 and to resistor bank 18 through cable 19. The pin 45 is connected to an inner conductive sleeve 43. The sleeve contains 32 electrode pins 44 distributed at an axial spacing of 10 mm and radially at 90 degrees to each other. The conductive sleeve is press fitted into a dielectric nozzle body 46. High voltage is also conducted to electrode stem 42 by means of a pin 47. The 32 electrodes 44, conductive sleeve 43 and electrode stem 42 help to create an intensive radial electrostatic field. The sleeve 43 is preferably made of polytetrafluoroethylene (PTFE) loaded with graphite to render it conductive.

Although the annular space between the sleeve 43 and rod 42 is shown as being in the shape of a hollow cylinder, it may have other cross-sectional shapes. For instance, it could flare out towards its exit end, to reduce the particle speed and therefore to increase the period during which the particles remain in the charging field.

The powder being fed to the nozzle assembly 15 passes through powder feed tube 22 and remains in this intensive electrostatic field sufficiently long to get charged thoroughly, thus reducing over-spray.

The general arrangement shown in FIGS. 1, 2 and 3 is to be used for automatic plant for coating small articles. When the same powder coating apparatus is to be used for coating large surface areas, the powder throughput through the impeller can be increased by feeding the powder through multiple nozzle assemblies. The number of nozzles supplying charged powder to the impeller can be selected to suit the amount of powder to be dispersed or deposited in the stipulated time without hampering the powder charging efficiency or the transfer efficiency. Articles of larger size can be coated by increasing the diameter of the conveyor loop, which diameter is proportional to the size of the articles to be powder coated.

Figure 5:
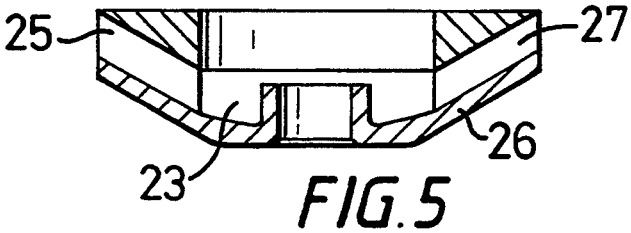
FIG. 5 is a sectional view along line V—V of the impeller shown in FIG. 4.
Figure 6:
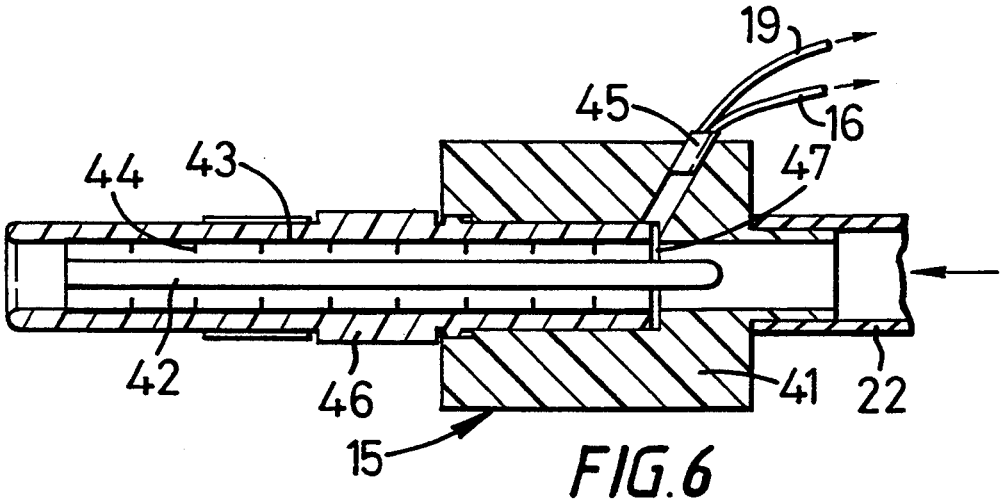
FIG. 6 is a sectional view of a nozzle assembly used for charging the powder.

For depositing charged powder efficiently on articles of greater size and further away from the powder sprayer, the speed of the powder particles near the articles is kept constant by replacing the impeller shown in FIGS. 3 and 5 by one with a different dish angle $\theta 2$ and of greater diameter, but having the same number of fins.

Figure 8:
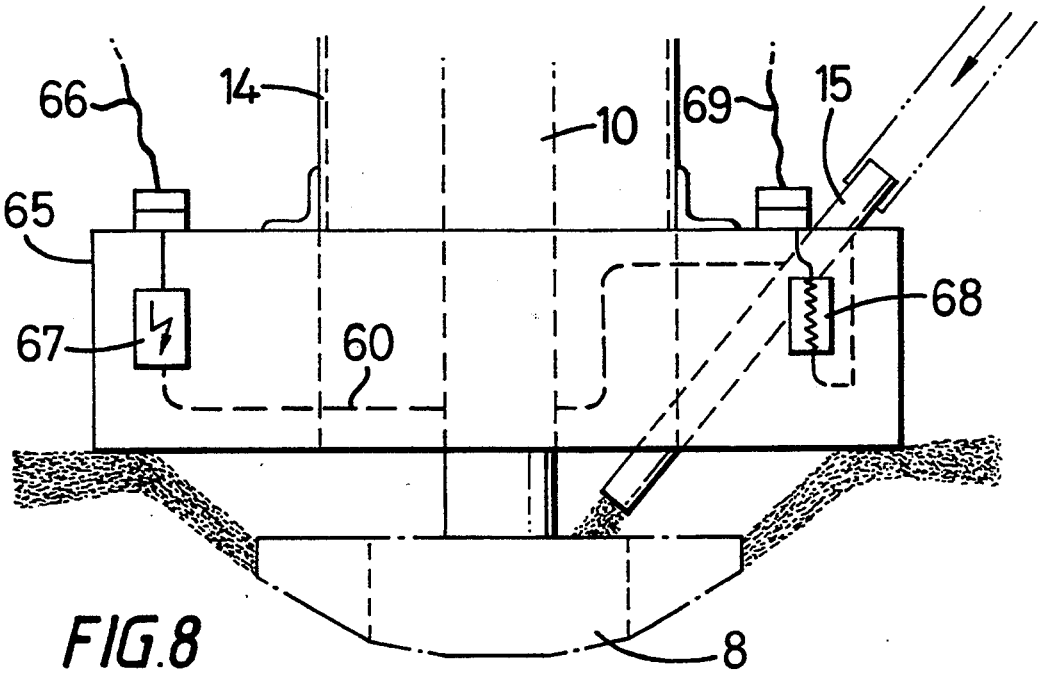
FIG. 8 is a view similar to FIG. 5 of an alternative impeller configuration.
Figure 9:
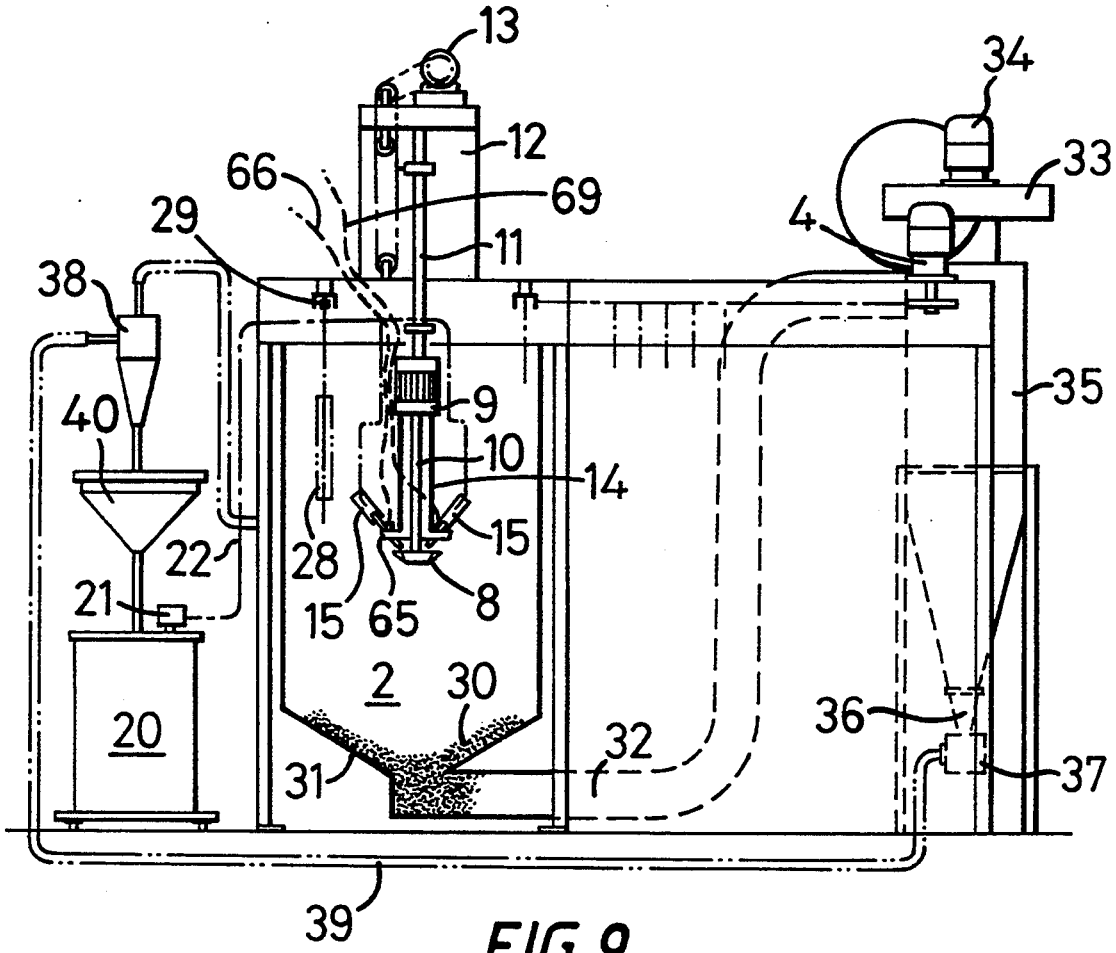
FIG. 9 is a view similar to FIG. 2 of apparatus using the impeller of FIG. 8.

Referring now to FIGS. 8 and 9 these show an alternative arrangement for the rotary impeller and of the nozzle assembly. Parts which are common to FIG. 2 and FIG. 9 carry the same reference numerals and likewise parts common to FIG. 3 and FIG. 8 carry the same reference numerals.

In the system shown in FIGS. 8 and 9, the high voltage supply is derived from a high voltage generator 67 which is mounted in a housing 65 attached to the bottom of sleeve 14. High voltage generator 67 is fed with a high frequency relatively low voltage controlled supply from suitable external power pack via a shielded cable 66. A high voltage lead 60 connects the output of the high voltage generator to nozzle assembly 15.

Discharge resistors 68 are likewise incorporated in the housing 65 attached to the bottom of sleeve 14 and connected to a cable 69 which enables the tip voltage on the nozzle assembly 15 to be monitored and indicated externally e.g. by a suitable indication on the power pack feeding the high voltage generator.

In use, the apparatus works as described above i.e. the high voltage applied via lead 60 to nozzle assembly 15 charges the powder as it passes through the nozzle assembly and comes into contact with the electrodes or pins fixed to the central electrode in the nozzle assembly. Faraday cage effects are substantially avoided.

The apparatus shown in FIG. 9 has, as can be seen, two nozzle assemblies 15 (only one of which is shown in FIG. 8 for the sake of clarity), which enables powder throughput to be increased. This can materially improve the efficiency of the overall apparatus since it substantially improves the amount of powder which can be applied in unit time. This is particularly important when using the apparatus to coat large surface area articles. Generally speaking for small articles a single nozzle assembly allows adequate coating powder to be delivered.

Figure 10:
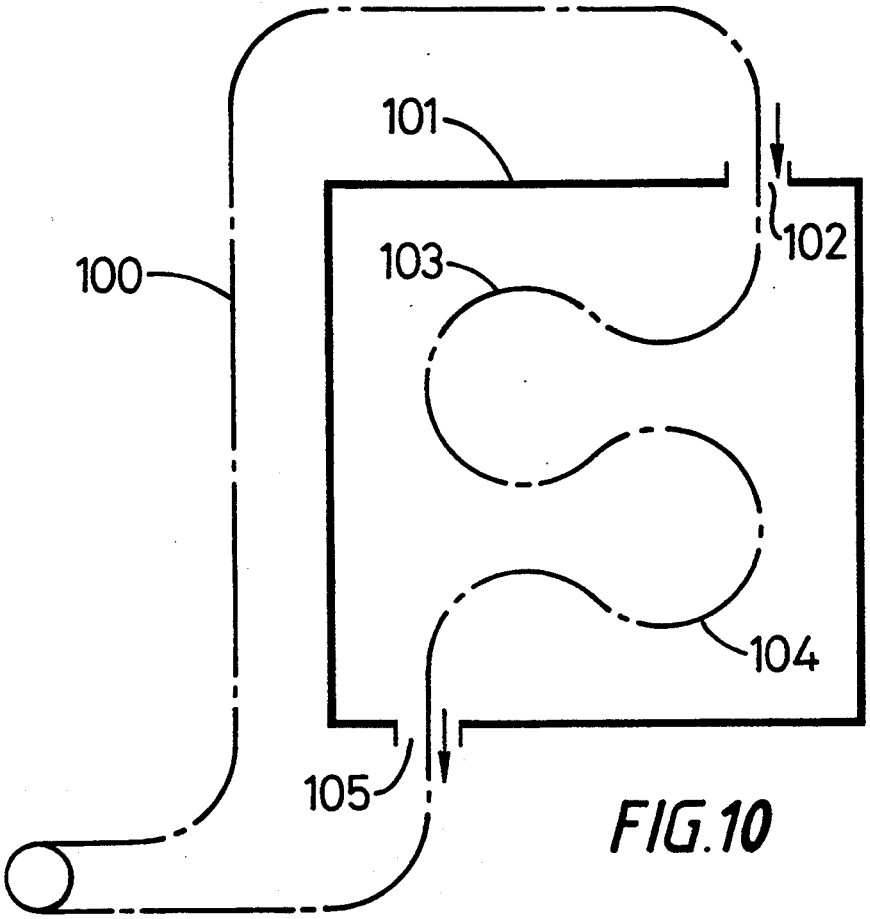
FIG. 10 is a plan view showing an alternative arrangement for the article conveyor.

A further improvement in efficiency may be obtained by using a conveyor shape as shown in plan in FIG. 10. This shows diagrammatically a conveyor track 100 around which article carrying devices may be moved. Part of the conveyor track moves such articles into a substantially closed housing 101 having an entrance 102 and an outlet 105. Within housing 101 the conveyor track is shaped into two bights 103 and 104 each consisting of a circular arc extending through around 270°. In the middle of each bight there is located a powder discharge unit consisting of fixed nozzles and rotary impeller as described above. It can be seen that large size articles can be moved through the two bights 103 and 104 without rotating relative to their suspension means on the conveyor but nevertheless they will present opposite sides to the impellers located in the centre of each bight, thus enabling two sides of a large article to be coated without having to rotate the article about its own vertical axis during the process save for the rotation caused relative to fixed housing 101 as the article moves round suspended on the conveyor. This is of particular advantage with large panel type articles which basically need to be coated on both sides since these cannot be rotated without the edges of them coming close to the central impeller disc, giving rise to problems. A further advantage of not rotating such panels is that limitations on conveyor speed which are imparted by indexing mechanisms can be ignored and the conveyor speed adjusted to take advantage of the high powder throughput to provide high overall throughput of articles to be coated.

Utmost care should be taken when increasing the powder throughput of the impeller that the powder concentration in the spray chamber should be kept in the safe powder/air concentration to avoid any explosion hazard. Such safety measures are beyond the scope of this invention and hence are not described herein in any greater detail.

I claim:

1. Apparatus for electrostatic powder coating, comprising a powder-spray module having (1) a substantially-vertical rotary shaft carrying an impeller at a lower end of said shaft, (2) a vertically movable sleeve surrounding in spaced relationship said rotary shaft and providing an air passageway in communication with said impeller, and (3) a non-rotatable nozzle assembly supported by the module and constructed and arranged to provide and transport a stream of electrostatically-charged powder downwardly to the center of the impeller; wherein the impeller comprises two parts, a lower part having an upwardly-facing concave inner surface, and an upper part having a downwardly-facing convex surface, and a plurality of substantially-vertical fins which are integral with either the upper part or the lower part, and the other part not integral with the fins is in contact with the fins in a manner so as to define therewith a plurality of upwardly-inclined powder-discharge passages; wherein air provided through said air passageway and centrifugal force provided by said impeller move said electrostatically-charged powder from said impeller to an article to be coated.

2. Apparatus as claimed in claim 1, in which the powder-spray module has an axis of rotation and is constructed and arranged to reciprocate along said axis of rotation.

3. Apparatus as claimed in claim 2, in which the powder-spray module is rotated by a motor mounted on a non-rotatable support which is reciprocal along its length under the action of a motor.

4. Apparatus as claimed in claim 3, in which the range of reciprocation of support is adjustable.

5. Apparatus as claimed in claims 2, 3, 4 or 1, in which the nozzle assembly comprises a tube of dielectric material having on an inner surface a tube of electroconductive material with projections extending inward from an inner face; a central metal rod spaced radially inwards from the projections; means for connecting both the tube of electroconductive material and the rod to a source of high voltage; and means for passing into the nozzle assembly a powder to be sprayed, wherein the powder is caused to flow axially of the nozzle assembly through an annular space present between the tube of electroconductive material and the rod.

6. Apparatus as claimed in claim 5, in which part of the outer surface of the dielectric tube is screw-threaded.

7. Apparatus as claimed in claim 1, in which the rotary shaft is of dielectric material.

8. Apparatus as claimed in claim 2, 3, 4, 1 or 7, in which the concave inner surface of the impeller includes an inner frustoconical surface of a large apex angle, and a contiguous outer frustoconical surface of an apex angle smaller than said large apex angle.

* * * * *